US007258832B2

(12) United States Patent
Sillén

(10) Patent No.: US 7,258,832 B2
(45) Date of Patent: Aug. 21, 2007

(54) DEVICE FOR TREATMENT OF IRON ALLOYS IN VESSEL

(75) Inventor: Rudolf Sillén, Ronneby (SE)

(73) Assignee: Novacast AB, Ronneby (SE)

( * ) Notice: Subject to any disclaimer, the term of this patent is extended or adjusted under 35 U.S.C. 154(b) by 384 days.

(21) Appl. No.: 10/484,509

(22) PCT Filed: Aug. 16, 2002

(86) PCT No.: PCT/SE02/01463

§ 371 (c)(1),
(2), (4) Date: Jan. 22, 2004

(87) PCT Pub. No.: WO03/016579

PCT Pub. Date: Feb. 27, 2003

(65) Prior Publication Data

US 2004/0195739 A1 Oct. 7, 2004

(30) Foreign Application Priority Data

Aug. 17, 2001 (SE) ..... 0102768

(51) Int. Cl.
*C21C 7/00* (2006.01)

(52) U.S. Cl. ..... 266/216; 266/275

(58) Field of Classification Search ..... 266/216, 266/275

See application file for complete search history.

(56) References Cited

U.S. PATENT DOCUMENTS

| | | | | |
|---|---|---|---|---|
| 3,650,516 | A * | 3/1972 | Mantell et al. | 266/216 |
| 4,034,970 | A * | 7/1977 | Akeel et al. | 266/216 |
| 4,484,731 | A * | 11/1984 | Taniguchi | 266/216 |
| 4,509,979 | A * | 4/1985 | Bauer | 266/216 |
| 5,100,110 | A * | 3/1992 | Alagarsamy | 266/216 |

FOREIGN PATENT DOCUMENTS

| | | |
|---|---|---|
| EP | 0 283 130 A2 | 9/1988 |
| GB | 1082057 | 9/1967 |
| GB | 2 102 837 A | 2/1983 |

* cited by examiner

*Primary Examiner*—Scott Kastler
(74) *Attorney, Agent, or Firm*—Buchanan Ingersoll & Rooney PC

(57) ABSTRACT

A device for processing iron alloys in a vessel is described. A reaction chamber for receiving at least one alloying material is arranged in the bottom of the vessel and a sprue of refractory material is arranged concentrically above the reaction chamber to form a gap between the lower end of the sprue and the upper delimitation of the reaction chamber.

4 Claims, 2 Drawing Sheets

DEVICE FOR TREATMENT OF IRON ALLOYS IN VESSEL

Figure 1:
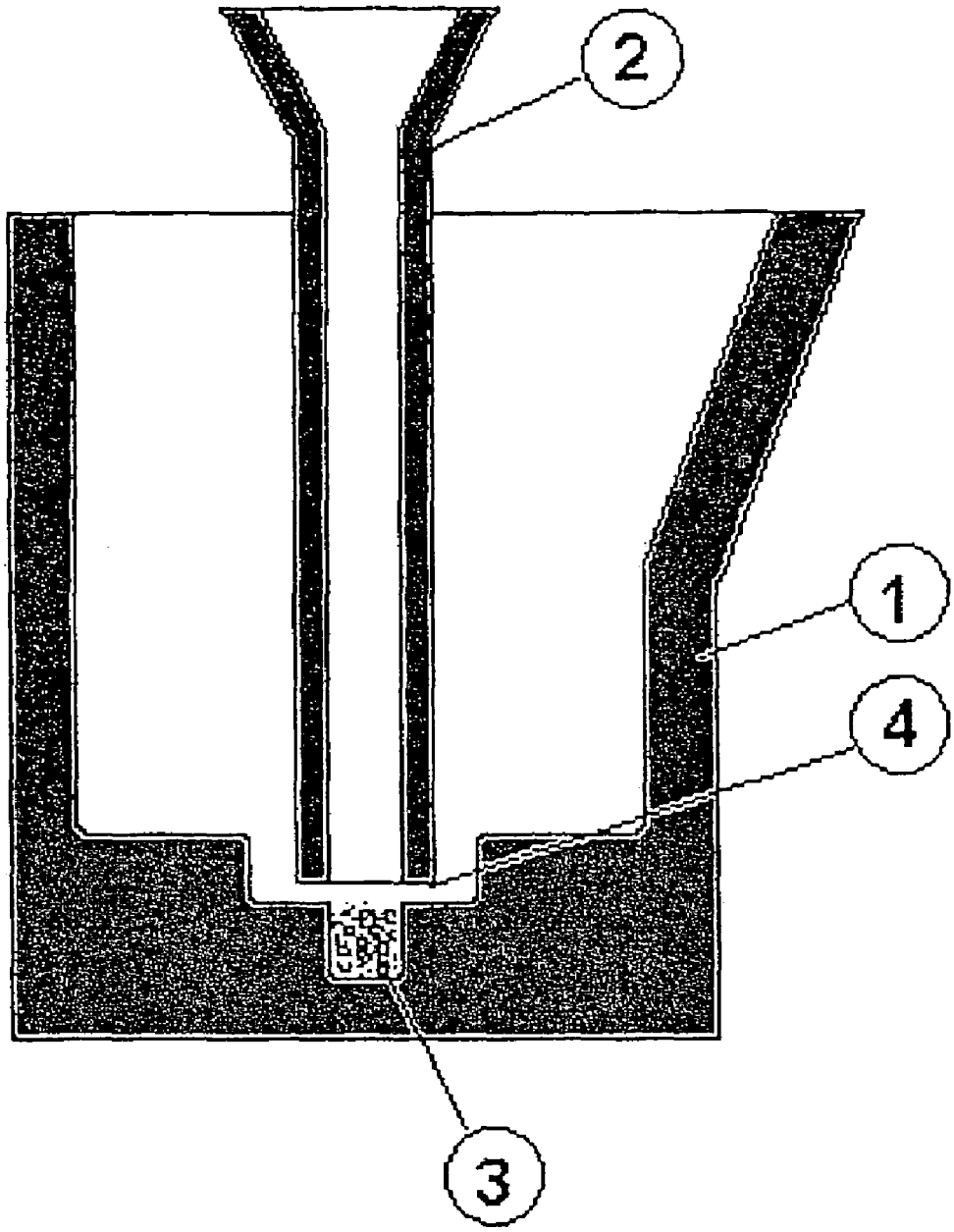

The present invention relates to treatment or processing of iron alloys and in particular to a device for processing iron alloys in a vessel.

When casting iron alloys, a modification of the alloy can take place prior to casting by supplying at least one alloying material to a pouring ladle or to a special processing vessel. The alloying material is usually supplied to a compartment or recess in the bottom of the vessel and is covered with, for example, steel clippings. The vessel is then filled with the base iron, and after a certain period of time the covering flux is dissolved and the alloying material contacts the base iron. The method is well suited for batchwise processing where there is time to wait for the alloying material to be dissolved and, by thermal convection and diffusion, to be evenly distributed in the melt. The processed melt is then ready for casting.

A different technique is to supply alloying materials successively during the actual casting process. One example is the InMold process. In the InMold process which is used for manufacturing nodular iron alloys, a reaction chamber is formed in the mould drag. At one edge the chamber is connected to the sprue of the gating system via a short duct, and at the other edge to a duct leading to the inlets to the casting. For instance when manufacturing nodular iron, a certain amount of crushed FeSiMg alloy containing about 5% magnesium is placed in the chamber. When casting, the iron flows into the chamber, the FeSiMg alloy melting on the surface and being gradually dissolved in the iron flowing through the chamber. The system is normally dimensioned so that 0.030 to 0.045% magnesium is dissolved in the iron which gradually fills the casting cavity. The magnesium content is affected by the contact area of the reaction chamber with the iron, the composition of the alloy and the teeming rate. The magnesium affects the solidification so that the carbon which is dissolved in the alloy is separated in the form of graphite nodules, which characterises nodular iron. If the amount of magnesium is too low, the iron can wholly or partly solidify as grey cast iron, which has significantly lower strength. To prevent this, the chamber is somewhat oversized. What is essential in the manufacture of nodular iron is that the amount of magnesium is not allowed to be lower than a certain minimum level. Higher contents than the standard value do not produce any considerable detrimental effects. When manufacturing compacted graphite iron, it is absolute necessary that the magnesium content be held within very narrow tolerances from about 0.008 to 0.011%. The advantage of processing the iron in the mould is that the fading-away of magnesium that takes place in processing in a pouring ladle and successive casting is eliminated. Owing to kinetic effects, nor is extra grafting of the iron necessary in most cases. A problem with processing in the mould is that space is required in the parting line of the mould to accommodate the reaction chamber and the associated ducts. This makes it difficult in practice to cast components whose weight exceeds about 200 kg. The present invention intends to eliminate this drawback and nevertheless keep the advantages of processing in moulds.

The present invention has been provided not only to eliminate the above drawback but also to achieve the advantages stated below.

Figure 2:
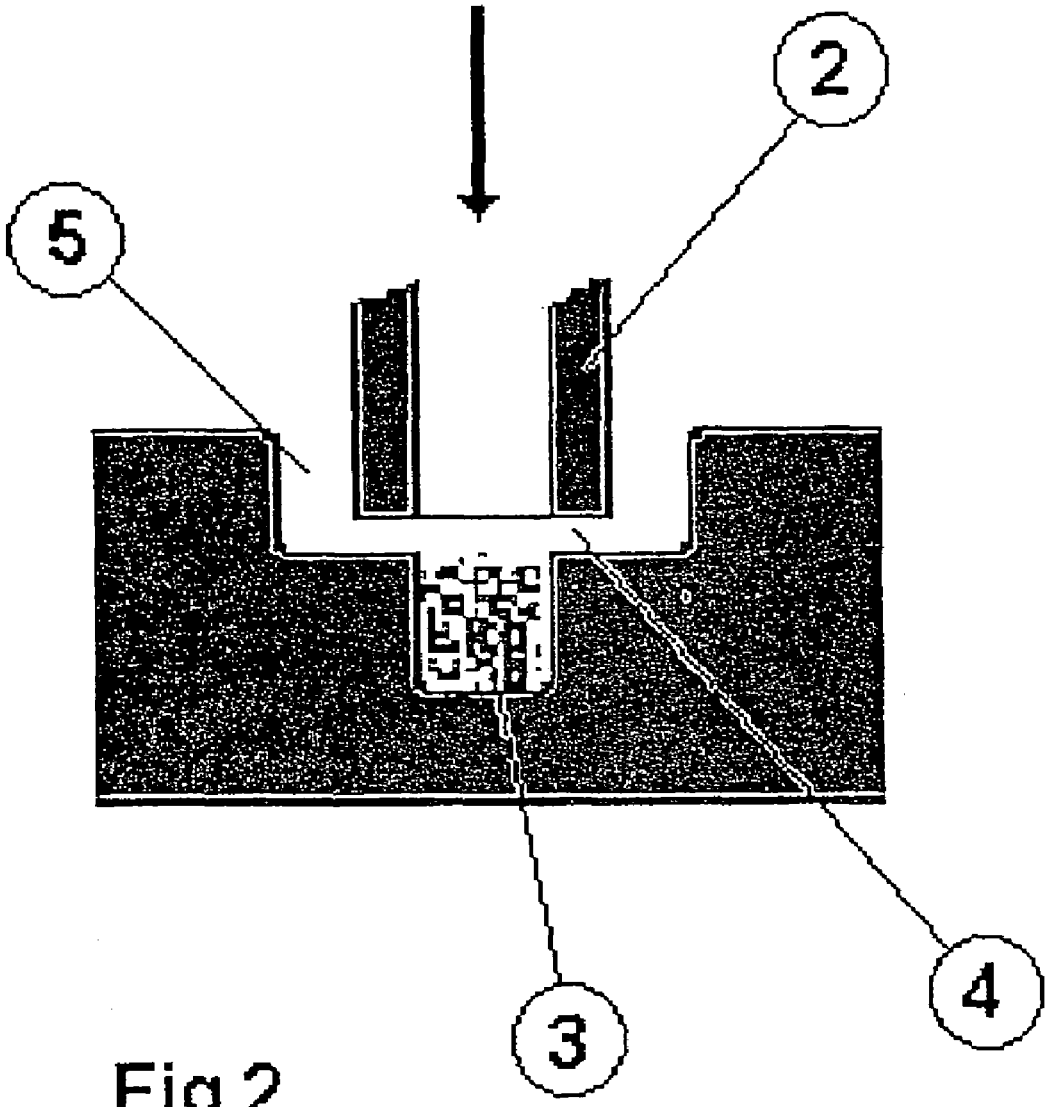

The invention will now be described in more detail with reference to the accompanying drawing, in which FIG. 1 is a cross-sectional view of a preferred embodiment of the device according to the invention, and FIG. 2 is a cross-sectional view of a detail of the device shown in FIG. 1.

With reference to the Figures, the processing of the base iron takes place in a processing vessel 1, which may consist of a pouring ladle. In the bottom of the processing vessel 1, there is formed a recess 5, preferably consisting of two concentric cylindrical cavities. The inner deeper cavity is a reaction chamber 3, where the alloying material or alloying materials are placed. It is preferred for the outer cavity to have a diameter which is about 3 times greater than the diameter of the reaction chamber. A sprue 2 of refractory material, in particular ceramic material, is arranged from above in the processing vessel 1 concentrically above the reaction chamber 3. The inner diameter of the sprue 2 is preferably the same as the diameter of the reaction chamber 3. The length of the sprue exceeds the depth of the processing vessel by at least about 100 mm. The sprue is arranged vertically so that its lower part forms a concentric gap 4 towards the horizontal surface of the outer cavity. In operation, the desired quantity of alloying material/materials is supplied through the sprue 2 to the reaction chamber 3. Subsequently the base metal is supplied through the sprue 2. The metal flows over the alloying material or materials which are gradually dissolved and into the processing vessel 1 through the gap which is formed between the sprue 2 and the outer cavity or recess 5. The volume and cross-sectional area of the reaction chamber 2 are calculated in prior-art manner according to the desired quantity of the alloying material and according to the desired metal flow when supplying base metal as a function of the base metal's absorption of the alloying material per unit area and unit of time. The metal flow is restricted by adjusting the gap between the sprue 2 and the outer recess 5.

The advantages of the suggested device are essentially as follows:

By causing the entire amount of metal to pass through a reaction chamber, quick and uniform dissolution of the alloying material is effected similarly to the InMold method.

The processing is quick and the iron is immediately ready for casting. As a result, the device may be combined with a founding furnace containing base iron, and the volume of the processing vessel is adjusted to the casting weight per mould. The use of a reaction chamber makes a covering flux unnecessary. By the reaction in processing with, for instance, magnesium, taking place in a practically acid-free environment, fading that normally occurs in processing in an open ladle is minimised. The batchwise processing before casting results in the metal being quite homogeneous. Large amounts of iron can be processed. In direct casting from the processing vessel, no grafting is required.

EMBODIMENT

In one embodiment for manufacturing castings of compacted graphite iron, a founding furnace is used. The furnace contains base iron for compacted graphite iron which is conditioned in a suitable manner. The moulds are conveyed automatically to a position in front of the founding furnace. The processing vessel which in this case is the same as the pouring ladle is arranged in a conveying and tilting device between the furnace and the mould. For a casting weight of 100 kg use is made of a pouring ladle with an average inner diameter of 250 mm and an inner height of 350 mm. To achieve the desired magnesium content of 0.009%, use is made of 380 g of an FeSiMg alloy containing 5% magnesium and having a particle size between 1 and 5 mm.

The pouring time in the ladle has been selected to be 15 s, which causes a flow rate of 6.7 kg/s. With an average pressure head during pouring of 200 mm, the cross-sectional area of the dimensioned gap will be 700 $mm^2$.

The cross-sectional area of the reaction chamber may thus in prior-art manner be calculated to be 260 $mm^2$. Since the density of the alloy is about 2.3 $g/cm^3$ a minimum height of 65 mm is required.

The size of the reaction chamber will thus be: diameter 60 mm and depth 90 mm. The outer concentrically arranged recess should preferably have a diameter of at least twice that of the reaction chamber, i.e. in this case 120 mm. The gap that controls the flow will have the height 5 mm. The depth of the outer recess is selected to be at least three times the height of the gap, in this case 15 mm.

The sprue is made of a graphite tube with an inner diameter of 60 mm, a wall thickness of 10 mm and a length of 400 mm. The upper part of the sprue is formed as a funnel.

The invention claimed is:

1. A device for processing iron alloys in a vessel comprising:

a reaction chamber for receiving at least one alloying material; and a sprue, wherein a recess is formed in the bottom of the vessel concentric with the reaction chamber, and that the sprue is arranged concentrically above the reaction chamber to form a gap between the lower end of the sprue and the upper delimitation of the reaction chamber.

2. A device as claimed in claim 1, wherein the depth of the recess from the bottom of the vessel is at least three times the outer height of the gap, and that the diameter of the recess is at least twice the diameter of the reaction chamber.

3. A device as claimed in claim 2, wherein the depth of the recess from the bottom of the vessel is at least 20 mm, and that the diameter of the outer recess is at least 30 mm greater than the diameter of the reaction chamber.

4. A device as claimed in claim 1, wherein the cross-sectional area and height of the reaction chamber are dimensioned to achieve the desired content of the alloying material for the given processing volume, that the inner diameter of the sprue is the same as or smaller than the upper diameter of the reaction chamber, and that the cross-sectional area of the gap is dimensioned for the desired flow of metal.

* * * * *